US012022888B2

(12) United States Patent
Ou

(10) Patent No.: US 12,022,888 B2
(45) Date of Patent: Jul. 2, 2024

(54) ATOMIZER AND ELECTRONIC ATOMIZATION DEVICE

(71) Applicant: Shenzhen Smoore Technology Limited, Shenzhen (CN)

(72) Inventor: Guoliang Ou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 910 days.

(21) Appl. No.: 17/086,337

(22) Filed: Oct. 31, 2020

(65) Prior Publication Data

US 2021/0137159 A1 May 13, 2021

(30) Foreign Application Priority Data

Nov. 8, 2019 (CN) ..... 201921919588.5

(51) Int. Cl.

| | |
|---|---|
| ***A24F 47/00*** | (2020.01) |
| ***A24F 7/00*** | (2006.01) |
| ***A24F 40/40*** | (2020.01) |

(52) U.S. Cl.

CPC ..... *A24F 7/00* (2013.01); *A24F 40/40* (2020.01)

(58) Field of Classification Search

CPC ..... A24F 40/40; A24F 40/42
See application file for complete search history.

(56) References Cited

U.S. PATENT DOCUMENTS

2011/0303231 A1* 12/2011 Li ..... A24F 40/42 131/329
2014/0261495 A1* 9/2014 Novak, III ..... H05B 3/46 392/386
2019/0183177 A1* 6/2019 Hubbard ..... A61M 15/06

FOREIGN PATENT DOCUMENTS

| | | | |
|---|---|---|---|
| CN | 203646507 | U | 6/2014 |
| CN | 206349571 | U | 7/2017 |
| CN | 206659108 | U | 11/2017 |
| CN | 207428423 | U | 6/2018 |
| CN | 104983076 | B | 7/2018 |
| CN | 207561378 | U | 7/2018 |
| CN | 208354606 | U | 1/2019 |
| CN | 208354607 | U | 1/2019 |
| CN | 208354608 | U | 1/2019 |
| CN | 109475186 | A | 3/2019 |
| CN | 110236228 | A | 9/2019 |
| CN | 209420953 | U | 9/2019 |
| CN | 110384265 | A | 10/2019 |
| CN | 209518784 | U | 10/2019 |
| WO | WO2016169052 | A1 | 10/2016 |

* cited by examiner

*Primary Examiner* — Eric Yaary

(57) ABSTRACT

An atomizer and an electronic atomization device are disclosed. The atomizer includes: a housing, having an outer wall; and a mouthpiece, having an inner wall, and the inner wall defining a cavity. A plurality of anti-rotation grooves are defined on one of the inner wall and the outer wall, one or more anti-rotation ribs are arranged on the other of the inner wall and the outer wall, and the number of the anti-rotation grooves is greater than or equal to the number of the anti-rotating ribs. The housing is assembled with the cavity, and the one or more anti-rotation ribs are engaged in the corresponding one or more of the plurality of anti-rotation grooves.

17 Claims, 6 Drawing Sheets

ATOMIZER AND ELECTRONIC ATOMIZATION DEVICE

CROSS REFERENCE TO RELATED APPLICATIONS

This application claims priority to Chinese Patent Application No. 201921919588.5 filed on Nov. 8, 2019, the content of which is herein incorporated by reference in its entirety.

TECHNICAL FIELD

The described embodiments relate to the field of atomizers, and in particular, to an atomizer and an electronic atomization device.

BACKGROUND

An electronic atomization device mainly includes an atomizer and a power supply assembly.

The atomizer can be filled with cigarette liquid and sealed with a mouthpiece mounted on the atomizer. In order to prevent the mouthpiece from rotating relative to a housing of the atomizer, the mouthpiece must be aligned with and installed to a specific structure of the housing of the atomizer. Therefore, during assembly of an electronic cigarette, large rotation and adjustments are often necessary to orient the mouthpiece relative to the housing of the atomizer, in order to complete the alignment and installation of the mouthpiece to the housing of the atomizer.

In the related art, it is inconvenient to align the mouthpiece with the housing of the atomizer, which affects an assembly efficiency of the atomizer.

SUMMARY

In some embodiments of the present disclosure, an atomizer and an electronic atomization device may be disclosed.

In some aspects of the present disclosure, an atomizer may be disclosed. The atomizer may include a housing, having an outer wall; and a mouthpiece, having an inner wall, and the inner wall defining a cavity. A plurality of anti-rotation grooves are defined on one of the inner wall and the outer wall, one or more anti-rotation ribs are arranged on the other of the inner wall and the outer wall, and the number of the anti-rotation grooves is greater than or equal to the number of the anti-rotating ribs. The housing is assembled with the cavity, and the one or more anti-rotation ribs are engaged in the corresponding one or more of the plurality of anti-rotation grooves.

In some embodiments, the inner wall or the outer wall defining the plurality of anti-rotation grooves comprises a pair of anti-rotation walls and a pair of guide walls located in each of the plurality of anti-rotation grooves. The pair of anti-rotation walls are spaced apart from each other; and the pair of guide walls are correspondingly connected to the pair of anti-rotation walls and extend away from each other from ends connected to the pair of anti-rotation walls in a direction facing away from the pair of anti-rotation walls, and the one or more anti-rotation ribs are capable of being engaged between the pair of anti-rotation walls along the pair of guide walls.

In some embodiments, a first guide chamfer is arranged at a junction between one of the pair of guide walls in one anti-rotation groove and an adjacent one of the pair of guide walls in an adjacent anti-rotation groove.

In some embodiments, each of the one or more anti-rotation ribs comprises: a pair of anti-rotation surfaces, opposite to each other; and a pair of guide surfaces, correspondingly connected to the pair of anti-rotation surfaces, wherein the pair of guide surfaces extend towards each other from ends connected to the pair of anti-rotation surfaces in a direction away from the pair of anti-rotation surfaces; the pair of guide surfaces cooperate with the pair of guide walls or the pair of anti-rotation walls of the corresponding anti-rotation groove such that the one or more anti-rotation ribs are engaged in the plurality of anti-rotation grooves.

In some embodiments, a second guide chamfer is arranged at a junction between the pair of guide surfaces.

In some embodiments, a tangent to a point in a central line of the each of the plurality of anti-rotation grooves is substantially parallel to or angled from a central line of the cavity.

In some embodiments, a protrusion is arranged on the inner wall of the mouthpiece along a circumferential direction of the inner wall, an engaging groove is defined on the outer wall of the housing, and the protrusion is engaged with the engaging groove.

In some embodiments, the protrusion is located above the plurality of anti-rotation grooves.

In some embodiments, the housing comprises a first column and a second column, the outer wall is arranged on the first column, the outer wall defines the plurality of anti-rotation grooves or has the one or more anti-rotation ribs arranged thereon, and the second column defines a liquid-storage chamber; the first column is connected to an end surface of the second column, and the end surface connected to the first column defines a liquid-injection hole; the liquid-injection hole is sealed by an elastic plug.

In some embodiments, the liquid-injection hole is integrally connected to the elastic plug and is configured to inject liquid into the liquid-storage chamber via a needle tube penetrating through the elastic plug.

In some embodiments, the atomizer further includes: an atomization assembly, disposed in the liquid-storage chamber and defining an atomization channel, wherein the first column defines an air-outlet channel, one end of the atomization channel is fluidly connected to the air-outlet channel, and the other end of the atomization channel is fluidly connected to a space outside the housing via a bottom wall of the liquid-storage chamber.

In some embodiments, the number of the anti-rotation ribs is at least two, and the plurality of anti-rotation grooves are evenly distributed on the inner wall; two adjacent of the plurality of anti-rotation ribs are spaced apart from each other at a first angle, and two adjacent of the at least two anti-rotation grooves are spaced apart from each other at a second angle, and the first angle is multiple of the second angle.

In some embodiments, the plurality of anti-rotation grooves are distributed on the inner wall at uneven intervals, and the number of the anti-rotation ribs is one.

In some embodiments, the mouthpiece further comprises an outer sidewall, and the inner wall is embedded in a space defined by the outer sidewall; one end of the inner wall facing away from the housing is connected to one end of the outer sidewall facing away from the housing, and an isolation cavity is defined between the inner wall and the outer sidewall.

In some aspects of the present disclosure, an electronic atomization device may be disclosed. The electronic atomization device may include a power supply assembly and the atomizer as previously described. The power supply assembly is configured to supply power to the atomizer, such that the atomizer is capable of atomizing cigarette liquid into smoke.

In some aspects of the present disclosure, an atomizer may be disclosed. The atomizer may include a housing, having an outer wall; and a mouthpiece, having an inner wall. A plurality of anti-rotation grooves are defined on one of the inner wall and the outer wall, one or more anti-rotation ribs are arranged on the other of the inner wall and the outer wall, and the number of the anti-rotation grooves is greater than or equal to the number of the anti-rotating ribs; when the housing is assembled with the mouthpiece, the one or more anti-rotation ribs are engaged in the corresponding one or more of the plurality of anti-rotation grooves and contact with the corresponding one or more of the plurality of anti-rotation grooves by a line contact.

BRIEF DESCRIPTION OF THE DRAWINGS

In order to more clearly describe the technical solutions in the embodiments of the present disclosure or the related art, the drawings that need to be used in the description of the embodiments or the related art will briefly descried in the following. Apparently, the drawings in the following description are only some embodiments of the present disclosure. For those skilled in the art, other drawings can be obtained based on these drawings without creative work.

DETAILED DESCRIPTION

The technical solutions in the embodiments of the present disclosure will be clearly and completely described in detail below with reference to the accompanying drawings in the embodiments of the present disclosure. It should be noted that, the embodiments described herein are only a part of the embodiments of the present disclosure, rather than all the embodiments. Based on the embodiments of the present disclosure, those skilled in the art may obtain other embodiments without any inventive work, all these belong to the protection scope of the present disclosure.

In some embodiments of the present disclosure, terms such as "first", "second", "third", and the like, are used herein for purposes of description, and are not intended to indicate or imply relative importance or significance or to imply the number of indicated technical features. Thus, the feature defined with "first", "second", "third", and the like may include one or more of such a feature. In the description of the present disclosure, it should be noted that, "a plurality of" means two or more, such as two, three, and the like, unless specified otherwise. In addition, the terms "include", "have", and any variation are intended to cover non-exclusive inclusion. For example, a process, method, system, product, or device that includes a series of steps or units is not limited to the listed steps or units, but optionally includes unlisted steps or units, or also optionally includes other steps or units inherent to the process, method, product or device.

"Embodiment" herein means that a particular feature, structure, or characteristic described with reference to embodiments may be included in at least one embodiment of the present disclosure. The term appearing in various places in the specification are not necessarily as shown in the same embodiment, and are not exclusive or alternative embodiments that are mutually exclusive with other embodiments. Those skilled in the art will understand explicitly and implicitly that the embodiments described herein may be combined with other embodiments.

Figure 1:
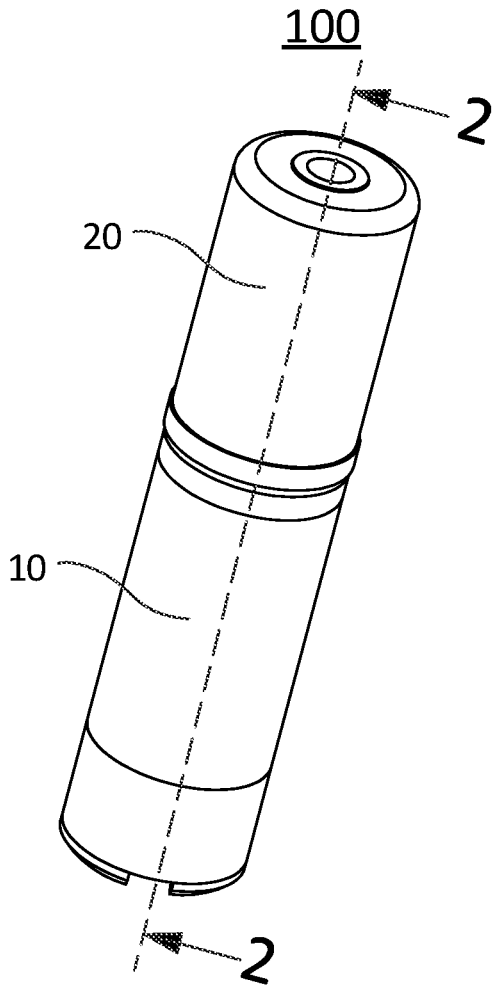
FIG. 1 is a schematic structural view of an atomizer according to some embodiments of the present disclosure.
Figure 2:
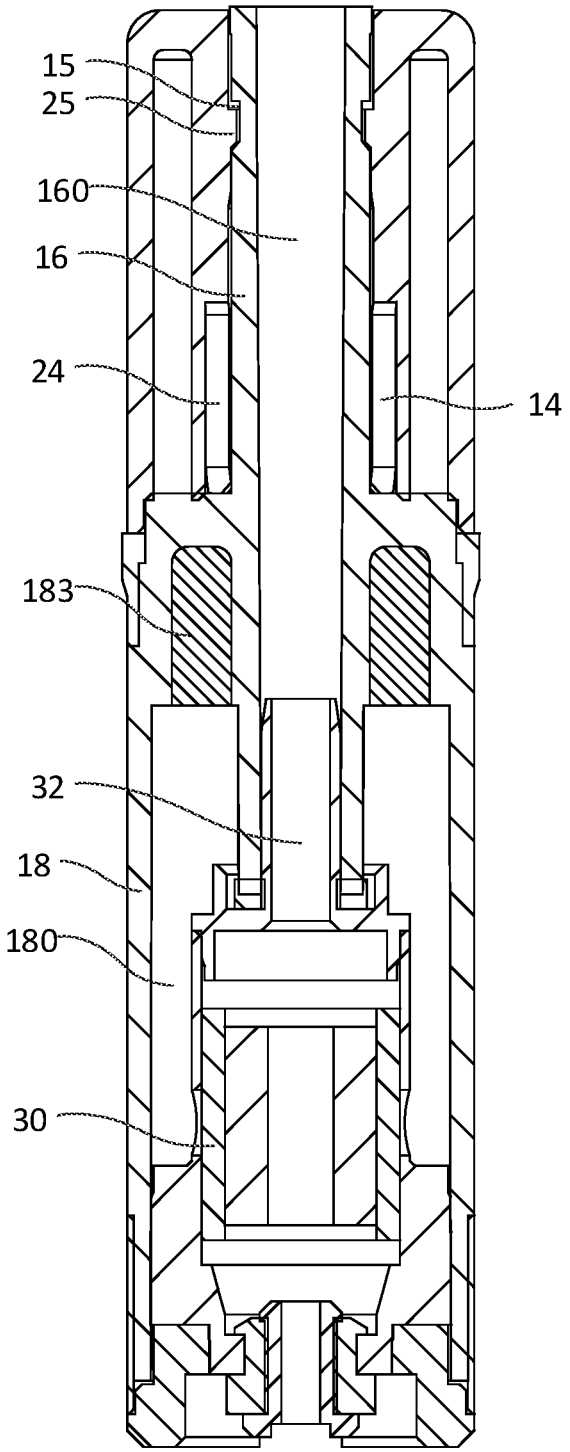
FIG. 2 is a cross-sectional view of the atomizer along 2-2 direction shown in FIG. 1.
Figure 3:
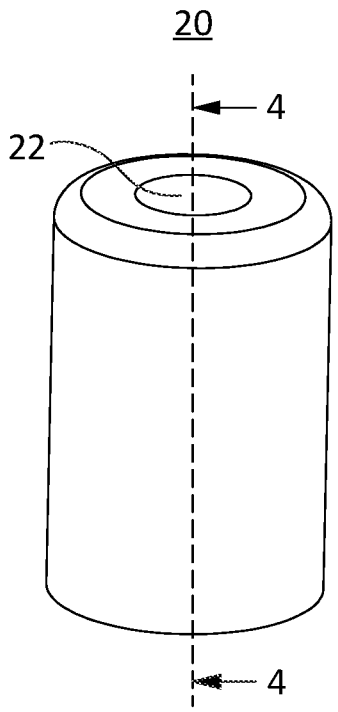
FIG. 3 is a schematic structural view of a mouthpiece shown in FIG. 1.
Figure 4:
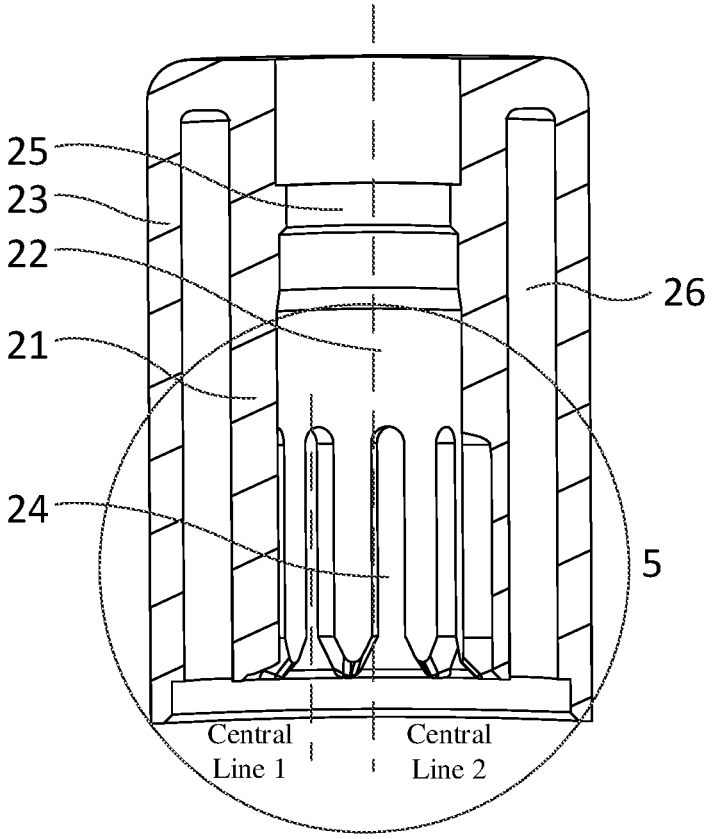
FIG. 4 is cross-sectional view of the mouthpiece along 4-4 direction shown in FIG. 3.
Figure 7:
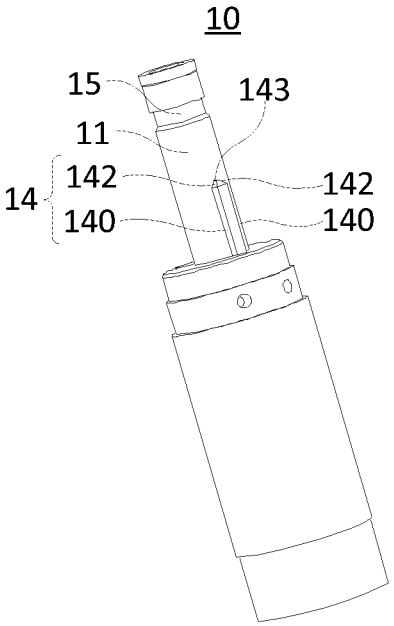
FIG. 7 is a schematic structural view of a housing shown in FIG. 1.

In some embodiments of the present disclosure, an atomizer may be provided. FIG. 1 is a schematic structural view of an atomizer according to some embodiments of the present disclosure, FIG. 2 is a cross-sectional view of the atomizer along A-A direction shown in FIG. 1, FIG. 3 is a schematic structural view of a mouthpiece shown in FIG. 1, FIG. 4 is cross-sectional view of the mouthpiece along B-B direction shown in FIG. 3, and FIG. 7 is a schematic structural view of a housing shown in FIG. 1.

As shown in FIGS. 1 to 4 and FIG. 7, the atomizer 100 may include a housing 10 and a mouthpiece 20.

The housing 10 may include an outer wall 11. The mouthpiece 20 may include an inner wall 21. The inner wall 21 may define a cavity 22. In some embodiments, the housing 10 may have a cylindrical configuration, and the cavity 22 may be cylindrical as a whole. In some embodiments, one of the inner wall 21 and the outer wall 11 may define a plurality of anti-rotation grooves 24. One or more anti-rotation ribs 14 may be disposed on the other of the inner wall 21 and the outer wall 11. The number of the anti-rotation grooves 24 may be greater than or equal to the number of the anti-rotation ribs 14. The housing 10 may be assembled with the cavity 22, and the one or more anti-rotation ribs 14 may be engaged in or snapped in the plurality of anti-rotation grooves 24.

In some embodiments, the plurality of anti-rotation grooves 24 may be arranged substantially parallel to each other and may be uniformly or evenly distributed on one of the inner wall 21 and the outer wall 11 at even intervals. In some embodiment, it is also possible that the plurality of anti-rotation grooves 24 may be arranged substantially parallel to each other but distributed on the other of the inner wall 21 and the outer wall 11 at uneven intervals. The above arrangements of the anti-rotation grooves 24 are both acceptable, and the present disclosure will not limit the specific arrangements of the anti-rotation grooves 24. Herein, "the plurality of anti-rotation grooves 24 may be arranged substantially parallel to each other" means that, walls defining the anti-rotation grooves 24 may be substantially parallel to each other, or extending directions or central lines of all the anti-rotation grooves 24 may be substantially parallel to each other.

In some embodiments, the number of the anti-rotation grooves 24 may be greater than or equal to the number of the anti-rotation ribs 14. In this way, each of the one or more anti-rotation ribs 14 may be aligned with and assembled with the corresponding one of the plurality of anti-rotation grooves 24, thereby limiting the relative rotation between the housing 10 and the mouthpiece 20.

In some embodiments, the plurality of anti-rotation grooves 24 may be evenly distributed on the inner wall 21, and the number of the anti-rotation grooves 24 may be 3, 5, 8, 10, or the like, which may be not limited in some embodiments of the present disclosure. In some embodiments, the number of the anti-rotation ribs 14 may be less than the number of the anti-rotation grooves 24. Besides, the distribution principle of the one or more anti-rotation ribs 14 may be the same as that of the plurality of anti-rotation grooves 24, that is to say, two adjacent anti-rotation ribs 14 are spaced apart from each other at a first angle, and two adjacent anti-rotation grooves 24 are spaced apart from each other at a second angle, the first angle may be multiple of the second angle.

Herein, the housing 10 may be substantially in shape of a cylinder, thus, a cross section of the housing 10 taken along a plane substantially perpendicular to a central axis of the cylinder may be substantially in shape of a circle. The two adjacent anti-rotation ribs 14 may be spaced apart from each other along a circumference direction of the outer wall 11. A first connecting line connects a central line of a first anti-rotation rib to the central axis of the housing 10, and a second connecting line connects a central line of a second anti-rotation rib to the central axis of the housing 10. Thus, "an angle between two adjacent anti-rotation ribs 14" refers to an angle form by the first connecting line and the second connecting line.

Similarity, the cavity 22 may be substantially in shape of a cylinder. The two adjacent anti-rotation grooves 24 may be spaced apart from each other along a circumference direction of the inner wall 21. A third connecting line connects a central line of a first anti-rotation groove to the central axis or the central line of the cavity 22, and a fourth connecting line connects a central line of a second anti-rotation groove to the central axis or the central line of the cavity 22. Thus, "an angle between two adjacent anti-rotation grooves 24" refers to an angle form by the third connecting line and the fourth connecting line.

For example, in case that eight anti-rotation grooves 24 are evenly distributed on the inner wall 21, the constant angle between adjacent anti-rotation grooves 24 may be 45 degrees. One anti-rotation rib 14 may be arranged on the outer wall 11. In this way, when the housing 10 is assembled with the cavity 22, the one anti-rotation rib 14 may be easily and conveniently engaged with one of the eight anti-rotation grooves 24. In some embodiments, it is also possible to arrange three anti-rotation ribs 14 on the outer wall 11, and the angel between every two adjacent anti-rotation ribs 14 may be multiples of 45 degrees. For example, the angle between the first anti-rotation rib and the second anti-rotation rib may be 45 degrees, and the between the second anti-rotation rib and the third anti-rotation rib may be 90 degrees. In this way, the three anti-rotation ribs 14 may also be easily and conveniently engaged with three of the eight anti-rotation grooves 24.

In some embodiments, the plurality of anti-rotation grooves 24 may also be distributed on the inner wall 21 at uneven intervals, that is, the angles between two adjacent anti-rotation grooves 24 may be uneven. In this case, one anti-rotation rib may be arranged on the outer wall 11, and the anti-rotation rib 14 may also be easily and conveniently engaged with one of the eight anti-rotation grooves 24.

As shown in FIG. 4, in some embodiments, all the plurality of anti-rotation grooves 24 may be evenly distributed on the inner wall 21. A central line 1 of each of the plurality of anti-rotation grooves 24 may be arranged substantially parallel to a central line 2 of the cavity 22. The one or more anti-rotation ribs 14 may be inserted or engaged into the plurality of anti-rotation grooves 24 along the central line 1 of the plurality of anti-rotation grooves 24.

Figure 6:
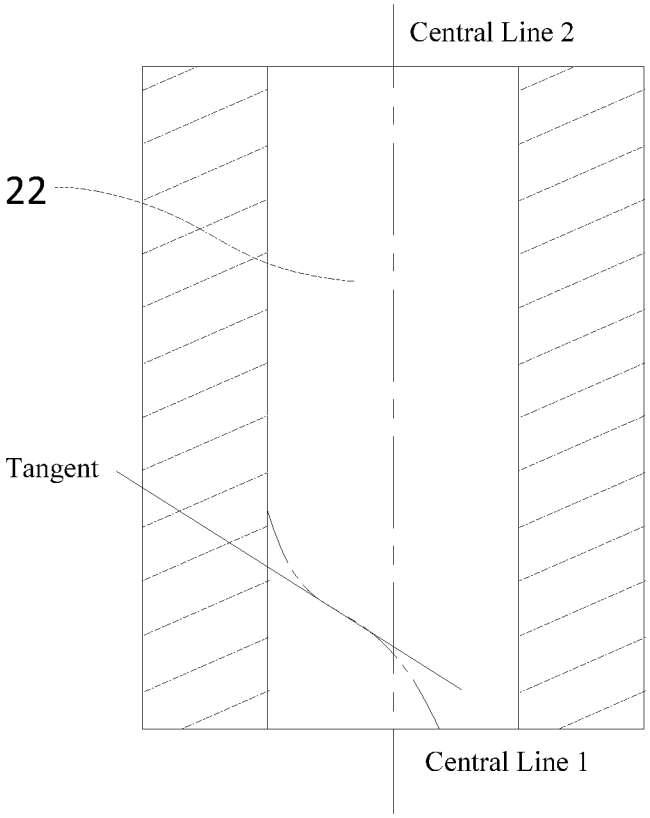
FIG. 6 is a schematic view showing a central line of an anti-rotation groove and a central line of a cavity when the anti-rotation groove is wound around an inner wall of the mouthpiece.

As shown in FIG. 6, in other embodiments, the plurality of anti-rotation grooves 24 may also be wound or surrounded on a circumference of the inner wall 21 with a certain slope, that is, a tangent to any point in the central line 1 of each anti-rotation groove 24 may be angled from the central line 2 of the cavity 22. The one or more anti-rotation ribs 14 may be also wound on the circumference of the outer wall 11, and the one or more anti-rotation ribs 14 may be engaged in the corresponding anti-rotation grooves 24.

In some embodiments of the present disclosure, one of the inner wall 21 of the mouthpiece 20 and the outer wall 11 of the housing 10 may define a plurality of anti-rotation grooves 24, and one or more anti-rotation ribs 14 may be disposed on the other of the inner wall 21 and the outer wall 11. The number of the anti-rotation grooves 24 may be greater than or equal to the number of the anti-rotation ribs 14. In this way, during the assembly of the housing 10 with the cavity 22 defined by the inner wall 21, difficulties of alignment and assembly between the one or more anti-rotation ribs 14 and the plurality of anti-rotation grooves 24 may be reduced. In this way, the one or more anti-rotation ribs 14 may be easily and conveniently engaged with the plurality of anti-rotation grooves 24. Thus, it is possible to reduce the risk that the mouthpiece 20 is rotated with respect to the housing 10.

Figure 5:
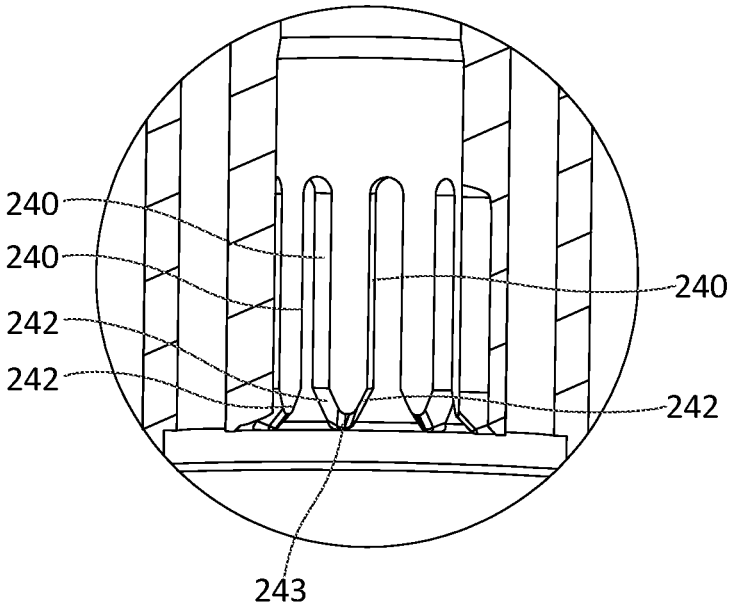
FIG. 5 is an enlarged view of an area 5 in the mouthpiece shown in FIG. 4.

As shown in FIG. 5, each of the plurality of anti-rotation grooves 24 may include a pair of anti-rotation walls 240 spaced apart from each other and a pair of guide walls 242 each connected to the corresponding one of the pair of spaced anti-rotation walls 240, respectively. That is to say, the inner wall 21 or the outer wall 11 which defines the plurality of anti-rotation grooves 24 may further include a pair of anti-rotation walls 240 and a pair of guide walls 242 in each anti-rotation groove 24. The pair of guide walls 242 may extend or expand from ends connected to the corresponding anti-rotation walls 240 in a direction facing away from the corresponding anti-rotation walls 240 and further extend away from each other (that is, a distance between ends of the pair of guide walls 242 that is connected to the anti-rotation walls 240 is less than a distance between opposite ends of the pair of guide walls 242 that is away from the anti-rotation walls 240), such that a flared or horn-shaped opening may be defined by the pair of guide walls 242, thereby facilitating the alignment between the one or more anti-rotation ribs 14 and the plurality of anti-rotation grooves 24, and reducing the difficulty of the alignment between the one or more anti-rotation ribs and the plurality of anti-rotation grooves 24, and the one or more anti-rotation ribs 14 may easily enter the space defined by the pair of anti-rotation walls 240 through the horn-shaped opening. More specifically, the one or more anti-rotation ribs 14 may be engaged between the pair of anti-rotation walls 240 along the pair of guide walls 242.

Furthermore, a first guide chamfer 243 may be arranged at a junction between one of the pair of guide walls 242 in one anti-rotation groove 24 and one of the pair of guide walls 242 in an adjacent anti-rotation groove 24, thereby further strengthening the guidance to the one or more anti-rotation ribs 14 to be engaged or locked into the anti-rotation grooves 24. In some embodiments, the first guide chamfer 243 may be substantially in shape of an arc or have a sharp angle.

As shown in FIG. 7, each of the one or more anti-rotation ribs 14 may include a pair of anti-rotation surfaces 140 opposite to each other or facing away from each other and a pair of guide surfaces 142 correspondingly connected to the pair of anti-rotation surfaces 140. In some embodiments, the two guide surfaces 142 may converge to or extend towards each other from ends connected to the pair of anti-rotation surfaces 140 in a direction away from the pair of anti-rotation surfaces 140, that is to say, the pair of guide surfaces 142 may extend towards each other from the ends connected to the corresponding anti-rotation surfaces 140 in a direction away from the corresponding anti-rotation surfaces 140. In this way, a head end of the anti-rotation rib 14 which firstly enters the corresponding anti-rotation groove 24 may be substantially in shape of a taper, thereby facilitating the alignment between the one or more anti-rotation ribs 14 and the plurality of anti-rotation grooves 24 and reducing the difficulty of the alignment between the one or more anti-rotation ribs 14 and the plurality of anti-rotation grooves 24. The pair of guide surfaces 142 may easily cooperate with the sidewalls of the corresponding anti-rotation groove 24 for guidance, such that the anti-rotation rib 14 may be engaged in the corresponding anti-rotation groove 24.

Herein, the sidewalls of the corresponding anti-rotation groove 24 may be the pair of guide walls 242 as previously described, or the sidewalls of the anti-rotation groove 24 may also be the pair of anti-rotation walls 240 as previously described.

Furthermore, a second guide chamfer 143 may be arranged at a junction between the pair of guide surfaces 142, thereby further strengthening the guidance to the one or more anti-rotation ribs 14 to be engaged into the corresponding anti-rotation groove 24, and reducing the difficulty of the alignment between the anti-rotation rib 14 and the anti-rotation grooves 24. In some embodiments, the second guide chamfer 143 may be in shape of an arc or have a sharp angle.

In some embodiments, the anti-rotation groove 24 may substantially have the pair of anti-rotation walls 240, the pair of guide walls 242, and the first guide chamfer 243 arranged therein. The anti-rotation rib 14 may substantially include the pair of anti-rotation surfaces 140, the pair of guide surfaces 142, and the second guide chamfer 143. In this way, during the assembly of the housing 10 with the cavity 22, the second guide chamfer 143 may firstly contact with the first guide chamfer 243 by a line contact. Then, the second guide chamfer 143 may slide to contact with the pair of guide walls 242 by a line contact and further slide towards the space define between the pair of anti-rotation walls 240 along the pair of guide walls 242. After that, the pair of guide surfaces 142 may contact with edges of the corresponding anti-rotation walls 240 by a line contact, and further slide towards the space defined between the pair of anti-rotation walls 240 with respect to the edges of the pair of anti-rotation walls 240, such that the pair of anti-rotation surfaces 140 may enter the space defined between the pair of anti-rotation walls 240. In some embodiments, the second guide chamfer 143 may directly slide towards into the space defined between the pair of anti-rotation walls 240 along the pair of guide walls 242. In some embodiments, the anti-rotation rib 14 may directly enter the space defined between the pair of anti-rotation walls 240.

With the above arrangement, the one or more anti-rotation ribs 14 may be easily and independently aligned and assembled with the plurality of anti-rotation grooves 24, that is, there is no need to manually adjust the position of the housing 10 or the position of the mouthpiece 20. During the assembly of the housing 10 and the cavity 22, the one or more anti-rotation ribs 14 may be automatically aligned with the plurality of anti-rotation grooves 24, which effectively reduces the difficulty of alignment between the one or more anti-rotation ribs 14 and the plurality of anti-rotation grooves 24. In this way, the assembly between the mouthpiece 20 and the housing 10 may be very convenient, and it is also possible to reduce the probability of occurrence of the relative rotation between the mouthpiece 20 and the housing 10.

Furthermore, as shown in FIGS. 4 and 7, a protrusion 25 may be arranged on the inner wall 21 of the mouthpiece 20 along a circumferential direction of the inner wall 21. An engaging groove 15 substantially in shape of an annulus may be defined on the outer wall 11 of the housing 10. The protrusion 25 may be engaged with the engaging groove 15.

In some embodiments, the protrusion 25 may be an annular rib arranged along the circumferential direction of the inner wall 21. In other embodiments, the protrusion 25 may also include a plurality of protruding ribs arranged at intervals along the same circumferential direction of the inner wall 21, which may not be limited in the present disclosure.

In some embodiments, the protrusion 25 may be located above the plurality of anti-rotation grooves 24, that is, the housing 10 may firstly pass an area in which the plurality of anti-rotation grooves 24 is located and then pass an area in which the protrusion 25 is located. A guide slope may be arranged at one side of the protrusion 25 facing the plurality of anti-rotation grooves 24, thereby facilitating a front end of the housing 10 to pass through the protrusion 25, and in turn facilitating the engagement of the protrusion 25 with the engaging groove 15.

Figure 8:
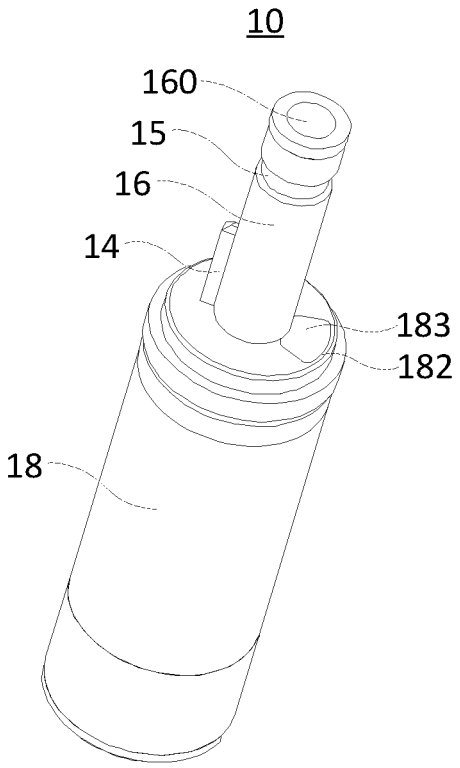
FIG. 8 is a schematic structural view of the housing in FIG. 7 viewed from another perspective.

As shown in FIGS. 2 and 8, the housing 10 may include a first column 16 and a second column 18. In some embodiments, the first column 16 and the second column 18 may be substantially in shape of a cylinder. The plurality of anti-rotation grooves 24 or the one or more anti-rotation ribs 14 may be provided on the outer wall 11 of the first column 16, and the second column 18 may define a liquid-storage chamber 180. The first column 16 may be connected to an end face of the second column 18. The end surface of the second column 18 connected to the first column 16 may define a liquid-injection hole 182. The liquid-injection hole 182 may communicate with or fluidly coupled to the liquid-storage chamber 180. The liquid-injection hole 182 may be closed or sealed by an elastic plug 183.

In some embodiments, the elastic plug 183 may cooperate with the liquid-injection hole 182. Thus, liquid may be injected into the liquid-storage chamber 180 when the elastic plug 183 is removed to open the liquid-injection hole 182.

In some embodiments, the liquid-injection hole 182 may be integrally connected to the elastic plug 183. For example, the housing 10 may be integrally connected to the elastic plug 183 by a two-color molding process or a secondary molding process. The elastic plug 183 may be formed at the liquid-injection hole 182. The liquid may be injected into the liquid-storage chamber 180 by utilizing a needle tube penetrating through the elastic plug 183, thereby effectively reducing the liquid leakage of the liquid-storage chamber 180.

For example, the elastic plug 183 may be made of silica gel. The housing 10 and the silica gel may be integrally connected to each other by the two-color molding process, thereby sealing the liquid-injection hole 182. In addition, since the silica gel is an elastic material, it is easy for the needle tube to penetrate therethrough. Besides, after injecting the liquid into the liquid-storage chamber 180 via the needle tube, the portion through which the needle tube penetrates may be recovered or restored to its original shape due to the elastic property of the elastic plug 183, to ensure that the injection hole 182 is enclosed or sealed again.

More specifically, the atomizer 100 may further include an atomization assembly 30, and the atomization assembly 30 may be arranged or received in the liquid-storage chamber 180. The atomization assembly 30 may further define an atomization channel 32. The first column 16 may define an air-outlet channel 160. One end of the atomization channel 32 may communicate with the air-outlet channel 160, and the other end of the atomization channel 32 may communicate with a space outside the housing 10 via a bottom wall of the liquid-storage chamber 180.

Therefore, in some embodiments, the liquid is injected inversely, and an end at which the liquid-injection hole is located may be located at a lower end, and the liquid may be injected into the liquid-storage chamber 180 through the needle tube penetrating through the elastic plug 183 from the lower end. When the cigarette liquid in the liquid-storage chamber 180 gradually increases, a pressure in liquid-storage chamber 180 may increase, such that the gas inside the liquid-storage chamber 180 may enter the atomization channel 32, thereby maintaining the pressure balance in the liquid-storage chamber 180 and ensuring that the liquid may be smoothly injected into the liquid-storage chamber 180.

More specifically, the atomizing assembly 30 may include a porous ceramic element, a liquid guiding element and a heating body. The porous ceramic element may have an atomization cavity. The liquid guiding element and the heating body may be arranged or received in the atomization cavity. The liquid guiding element may wrap the heating body and may also be attached to an inner wall of the atomization cavity. The porous ceramic element may define a through hole. The cigarette liquid may be conducted to the liquid guiding element through the through hole. The heating body may atomize the cigarette liquid into smoke. The porous ceramic element may define the atomization channel 32, and the atomization channel 32 may be fluidly connected to or communicate with the atomization cavity. In this way, the smoke in the atomization cavity may be flowed or poured into a mouth of a user through the atomization channel 32 and the air-outlet channel 160 when the user is inhaling or sucking.

Furthermore, as shown in FIG. 4, the mouthpiece 20 may include an inner wall 21 and an outer sidewall 23, and the inner wall 21 may be embedded or received in the space formed by the outer sidewall 23. One end of the inner wall 21 facing away from the housing 10 may be connected to one end of the outer sidewall 23 facing away from the housing 10. An isolation cavity 26 may be defined between the inner wall 21 and the outer sidewall 23. The isolation cavity 26 may help to isolate the heat conducted from the inner wall 21, in order to reduce the risk of burning the lip.

Figure 9:
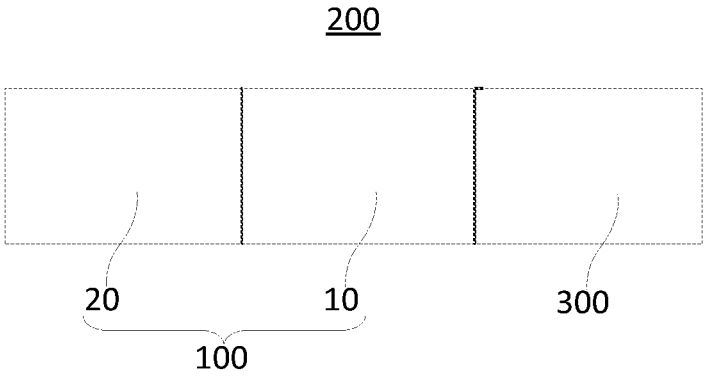
FIG. 9 is a schematic structural view of an electronic atomization device according to some embodiments of the present disclosure.

As shown in FIG. 9, an electronic atomization device 200 may also be provided in some embodiments of the present disclosure. The electronic atomization device 200 may include a power supply assembly 300 and the above-mentioned atomizer 100. The power supply assembly 300 may be configured to supply power to the atomizer 100. In this way, the atomizer 100 may atomize the cigarette liquid into smoke.

In some embodiments of the present disclosure, a plurality of anti-rotation grooves may be distributed on one of the inner wall of the mouthpiece and the outer wall of the housing, and one or more anti-rotation ribs may be arranged on the other of the inner wall and the outer wall. The number of the plurality of anti-rotation grooves may be greater than or equal to the number of the one or more anti-rotation ribs. In this way, during the assembly of the housing assembled with the cavity defined by the inner wall, difficulties in alignment and assembly between the one or more anti-rotation ribs and the plurality of anti-rotation grooves may be reduced. In this way, the one or more anti-rotation ribs may easily and conveniently engage with the plurality of anti-rotation grooves. Thus, it is possible to reduce the possibility that the mouthpiece is rotated with respect to the housing.

The above may be only embodiments of the present disclosure, and do not limit the scope of the present disclosure. Any equivalent structure or equivalent process transformation made by using the description and drawings of the present disclosure, or directly or indirectly applied to other related technologies, may be included in the protection scope of the present disclosure.

What is claimed is:

1. An atomizer, comprising:

a housing, having an outer wall; and a mouthpiece, having an inner wall, and the inner wall defining a cavity;

wherein a plurality of anti-rotation grooves are defined on one of the inner wall and the outer wall, one or more anti-rotation ribs are arranged on the other of the inner wall and the outer wall, and the number of the anti-rotation grooves is greater than the number of the anti-rotating ribs;

the housing is assembled with the cavity, and the one or more anti-rotation ribs are engaged in a corresponding one or more of the plurality of anti-rotation grooves;

the housing comprises a first column and a second column, the outer wall is arranged on the first column, the outer wall defines the plurality of anti-rotation grooves or has the one or more anti-rotation ribs arranged thereon, and the second column defines a liquid-storage chamber;

the first column is connected to an end surface of the second column, and the end surface connected to the first column defines a liquid-injection hole;

the liquid-injection hole is sealed by an elastic plug.

2. The atomizer as claimed in claim 1, wherein the inner wall or the outer wall defining the plurality of anti-rotation grooves comprises a pair of anti-rotation walls and a pair of guide walls located in each of the plurality of anti-rotation grooves;

wherein the pair of anti-rotation walls are spaced apart from each other; and the pair of guide walls are correspondingly connected to the pair of anti-rotation walls and extend away from each other from ends connected to the pair of anti-rotation walls in a direction facing away from the pair of anti-rotation walls, and the one or more anti-rotation ribs are capable of being engaged between the pair of anti-rotation walls along the pair of guide walls.

3. The atomizer as claimed in claim 2, wherein a first guide chamfer is arranged at a junction between one of the pair of guide walls in one anti-rotation groove and an adjacent one of the pair of guide walls in an adjacent anti-rotation groove.

4. The atomizer as claimed in claim 2, wherein each of the one or more anti-rotation ribs comprises:

a pair of anti-rotation surfaces, opposite to each other; and a pair of guide surfaces, correspondingly connected to the pair of anti-rotation surfaces, wherein the pair of guide surfaces extend towards each other from ends connected to the pair of anti-rotation surfaces in a direction away from the pair of anti-rotation surfaces; the pair of guide surfaces cooperate with the pair of guide walls or the pair of anti-rotation walls of the corresponding anti-rotation groove such that the one or more anti-rotation ribs are engaged in the plurality of anti-rotation grooves.

5. The atomizer as claimed in claim 4, wherein a second guide chamfer is arranged at a junction between the pair of guide surfaces.

6. The atomizer as claimed in claim 1, wherein a tangent to a point in a central line of the each of the plurality of anti-rotation grooves is substantially parallel to or angled from a central line of the cavity.

7. The atomizer as claimed in claim 1, wherein a protrusion is arranged on the inner wall of the mouthpiece along a circumferential direction of the inner wall, an engaging groove is defined on the outer wall of the housing, and the protrusion is engaged with the engaging groove.

8. The atomizer as claimed in claim 1, wherein the liquid-injection hole is integrally connected to the elastic plug and is configured to inject liquid into the liquid-storage chamber via a needle tube penetrating through the elastic plug.

9. The atomizer as claimed in claim 1, further comprising:

an atomization assembly, disposed in the liquid-storage chamber and defining an atomization channel, wherein the first column defines an air-outlet channel, one end of the atomization channel is fluidly connected to the air-outlet channel, and the other end of the atomization channel is fluidly connected to a space outside the housing via a bottom wall of the liquid-storage chamber.

10. The atomizer as claimed in claim 1, wherein the number of the anti-rotation ribs is at least two, and the plurality of anti-rotation grooves are evenly distributed on the inner wall;

two adjacent anti-rotation ribs of the plurality of anti-rotation ribs are spaced apart from each other at a first angle, and two adjacent anti-rotation grooves of the at least two anti-rotation grooves are spaced apart from each other at a second angle, and the first angle is a multiple of the second angle.

11. The atomizer as claimed in claim 1, wherein the plurality of anti-rotation grooves are distributed on the inner wall at uneven intervals, and the number of the anti-rotation ribs is one.

12. The atomizer as claimed in claim 1, wherein the mouthpiece further comprises an outer sidewall, and the inner wall is embedded in a space defined by the outer sidewall;

one end of the inner wall facing away from the housing is connected to one end of the outer sidewall facing away from the housing, and an isolation cavity is defined between the inner wall and the outer sidewall.

13. An electronic atomization device, comprising:

a power supply assembly; and an atomizer, wherein the power supply assembly is configured to supply power to the atomizer, the atomizer is capable of atomizing cigarette liquid into smoke; the atomizer comprises:

a housing, having an outer wall; and a mouthpiece, having an inner wall, and the inner wall defining a cavity;

wherein a plurality of anti-rotation grooves are defined on one of the inner wall and the outer wall, one or more anti-rotation ribs are arranged on the other of the inner wall and the outer wall, and the number of the anti-rotation grooves is greater than the number of the anti-rotating ribs;

the housing is assembled with the cavity, and the one or more anti-rotation ribs are engaged in a corresponding one or more of the plurality of anti-rotation grooves;

the housing comprises a first column and a second column, the outer wall is arranged on the first column, the outer wall defines the plurality of anti-rotation grooves or has the one or more anti-rotation ribs arranged thereon, and the second column defines a liquid-storage chamber;

the first column is connected to an end surface of the second column, and the end surface connected to the first column defines a liquid-injection hole;

the liquid-injection hole is sealed by an elastic plug.

14. The electronic atomization device as claimed in claim 13, wherein the inner wall or the outer wall defining the plurality of anti-rotation grooves comprises a pair of anti-rotation walls and a pair of guide walls located in each of the plurality of anti-rotation grooves;

wherein the pair of anti-rotation walls are spaced apart from each other; and the pair of guide walls are correspondingly connected to the pair of anti-rotation walls and extend away from each other from ends connected to the pair of anti-rotation walls in a direction facing away from the pair of anti-rotation walls, and the one or more anti-rotation ribs are capable of being engaged between the pair of anti-rotation walls along the pair of guide walls.

15. The electronic atomization device as claimed in claim 14, wherein each of the one or more anti-rotation ribs comprises:

a pair of anti-rotation surfaces, opposite to each other; and a pair of guide surfaces, correspondingly connected to the pair of anti-rotation surfaces, wherein the pair of guide surfaces extend towards each other from ends connected to the pair of anti-rotation surfaces in a direction away from the pair of anti-rotation surfaces; the pair of guide surfaces cooperate with the pair of guide walls or the pair of anti-rotation walls of the corresponding anti-rotation grooves such that the one or more anti-rotation ribs are engaged in the plurality of anti-rotation grooves.

16. The electronic atomization device as claimed in claim 13, wherein a protrusion is arranged on the inner wall of the mouthpiece along a circumferential direction of the inner wall, an engaging groove is defined on the outer wall of the housing, and the protrusion is engaged with the engaging groove.

17. An atomizer, comprising:

a housing, having an outer wall; and a mouthpiece, having an inner wall;

wherein a plurality of anti-rotation grooves are defined on one of the inner wall and the outer wall, one or more anti-rotation ribs are arranged on the other of the inner wall and the outer wall, and the number of the anti-rotation grooves is greater than the number of the anti-rotating ribs;

when the housing is assembled with the mouthpiece, the one or more anti-rotation ribs are engaged in the corresponding one or more of the plurality of anti-rotation grooves and contact with the corresponding one or more of the plurality of anti-rotation grooves by a line contact;

the housing comprises a first column and a second column, the outer wall is arranged on the first column, the outer wall defines the plurality of anti-rotation grooves or has the one or more anti-rotation ribs arranged thereon, and the second column defines a liquid-storage chamber;

the first column is connected to an end surface of the second column, and the end surface connected to the first column defines a liquid-injection hole; and the liquid-injection hole is sealed by an elastic plug.

* * * * *